United States Patent [19]

Nozaki

[11] 4,440,990

[45] Apr. 3, 1984

[54] MEMBRANE KEYBOARD ASSEMBLY

[75] Inventor: Satoru Nozaki, Northridge, Calif.

[73] Assignee: SMK Electronics Corporation, USA, Carson, Calif.

[21] Appl. No.: 379,709

[22] Filed: May 19, 1982

[51] Int. Cl.[3] ..... H01H 9/00

[52] U.S. Cl. ..... 200/5 A; 200/159 B; 200/305

[58] Field of Search ..... 200/5 A, 159 B, 305, 200/292

[56] References Cited

U.S. PATENT DOCUMENTS

| | | | |
|---|---|---|---|
| 4,243,852 | 1/1981 | Larson | 200/267 X |
| 4,287,394 | 9/1981 | Hargita et al. | 200/267 X |
| 4,303,960 | 12/1981 | Sherwood et al. | 200/305 X |

*Primary Examiner*—E. A. Goldberg

*Assistant Examiner*—Morris Ginsburg

*Attorney, Agent, or Firm*—Oblon, Fisher, Spivak, McClelland & Maier

[57] ABSTRACT

The membrane keyboard assembly comprises upper and lower membrane keyboards, a spacer interposed therebetween and a common flexible base including two half portions associated with the upper and lower membrane keyboards. The flexible base has silver paint contact areas and connection lines printed thereon and the silver paint connection lines have gaps at spaced points along their length. Resistive layers are applied on the contact areas and connection lines including the gaps therein so that suppression resistances in series connected across the connection lines are formed. The resistance value of the suppression resistances can be varied by suitably selecting the length and width of the connection lines.

8 Claims, 5 Drawing Figures

MEMBRANE KEYBOARD ASSEMBLY

BACKGROUND OF THE INVENTION

This invention relates to a membrane keyboard assembly for use in a membrane keyboard switch device.

There have been proposed and practically employed a variety of membrane keyboard assemblies for use in a membrane keyboard switch device and in most of the conventional membrane keyboard assemblies, the flexible base has connection lines and contact areas formed thereon by applying electrically conductive ink to the base by the screen printing. As the electrically conductive ink to be used for the purpose, silver paint has been generally employed. However, the silver paint oxidizes easily and also presents a serious migration problem and thus it has been generally followed that resistive layers are applied to the connection lines and contact areas on the base by the screen printing of resistive paint. As the resistive paint, carbon paint has been generally employed. Although the carbon paint has a relatively low electric conductivity and a relatively high inherent resistance because of its characteristic properties, the carbon paint has an excellent stability in its resistance value after the resistance value has been initially set.

The membrane keyboard assembly functions to open and close the switch in which the membrane keyboard assembly is incorporated as its component when the membrane keyboard assembly is depressed down by a human finger. However, at the time of depressing down, the membrane keyboard assembly has a high potential possibility to receive static electricity from a human body or other objects. Therefore, the membrane keyboard switch device employing the membrane keyboard assembly as its component is provided with an external grounding circuit such as a resistance or capacitor as a discharge means when the membrane keyboard assembly receives such static electricity.

As shown in FIG. 13 of U.S. Pat. No. 4,145,584, for example, the discharge resistance is electrically connected to a line outside of the membrane keyboard assembly. However, in such an arrangement, there is the disadvantage that the cost for purchase of the resistance itself and that for connecting the resistance to the line are added to the cost of the membrane keyboard switch device employing the membrane keyboard assembly resulting in an expensive membrane keyboard switch device. In addition, such an arrangement has the disadvantage that the switch device inevitably becomes a large size device.

SUMMARY OF THE INVENTION

Therefore, one object of the present invention is to reduce the cost of a membrane keyboard assembly and that of a membrane keyboard switch device incorporating such a membrane keyboard assembly therein as its component.

Another object of the present invention is to form a suppression resistance and to connect the discharge resistance to a line simultaneously with the formation of a resistive layer on the base.

Another object of the present invention is to form a suppression resistance with a portion of a resistive layer.

A further object of the present invention is to provide a suppression resistance within a membrane keyboard assembly without increasing the size of a membrane keyboard assembly and of a membrane keyboard switch device incorporating the membrane keyboard assembly therein as its component.

A still further object of the present invention is to attain the above-mentioned objects by providing a line applied on a flexible base with spaced gaps and connecting between the adjacent gaps by means of a resistance whereby the resistive layer portion present between the gaps function as a suppression resistance.

According to the present invention, there has been provided a membrane keyboard assembly for use in a membrane keyboard switch device which essentially comprises an upper membrane keyboard having a flexible surface sheet including switch indications means printed thereon disposed on the top of the upper membrane keyboard, a lower membrane keyboard having a bottom plate disposed on the undersurface of the lower membrane keyboard and an apertured spacer interposed between the two membrane keyboards, said membrane keyboard assembly comprising a flexible base in common to the two membrane keyboards and folded upon itself to provide first and second half portions associated with said first and second membrane keyboards, respectively, the latter of which including an extension, a plurality of first contact areas on said base half portion and a plurality of first connection lines on said base first half portion for connecting between the contact areas, a plurality of second contact areas on said base second half portion and a plurality of second connection lines on said base second half portion for connecting between the second contact areas, said second contact areas and connection lines corresponding to said first contact areas and connection lines with respect to number and location, respectively and said first and second connection lines extending onto said extension of the base second half portion and the portions of the connection lines on the extension being formed at spaced points along their length with gaps to break the lines, and resistive layers applied to said first and second contact areas and said first and second connection lines, whereby the portions of said resistive layers present in the gaps in said portions of the first and second connection lines on said extension of the base second half portion form suppression resistances.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

Figure 1:
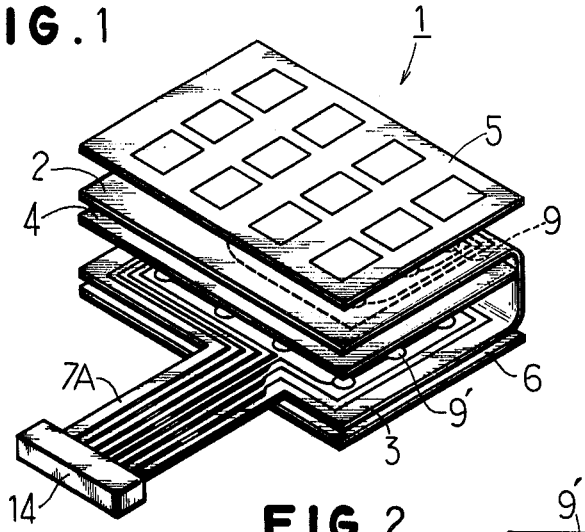
FIG. 1 is a perspective view of a membrane keyboard switch device employing the membrane keyboard assembly constructed in accordance with the principle of the present invention.

Referrring first to FIG. 1 in which a membrane keyboard switch device incorporating the membrane keyboard assembly of the invention therein as its component is illustrated. The membrane keyboard switch device is generally shown by reference numeral 1 and generally comprises an upper membrane keyboard 2, a lower membrane keyboard 3 and an apertured spacer sheet 4 interposed between the upper and lower membrane keyboards 2, 3. A flexible surface sheet 5 on which a switch indication or the like is printed is disposed on the top of the upper membrane keyboard 2 and a bottom plate 6 is disposed on the undersurface of the lower membrane keyboard 3.

Figure 2:
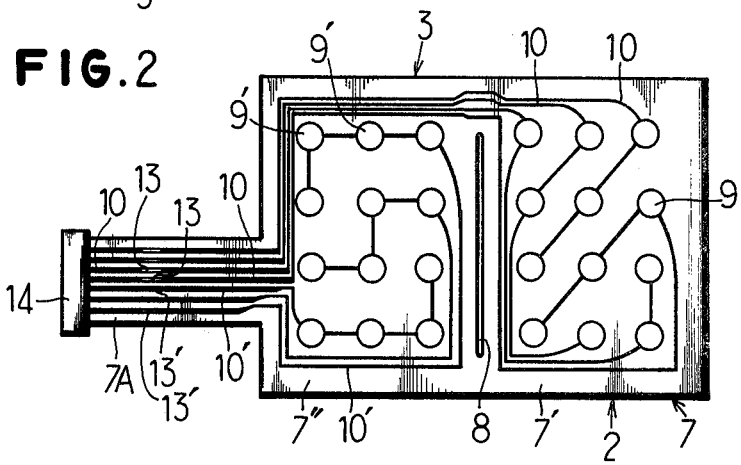
FIG. 2 is a plan view of one preferred embodiment of the membrane keyboard assembly according to the present invention.
Figure 3:
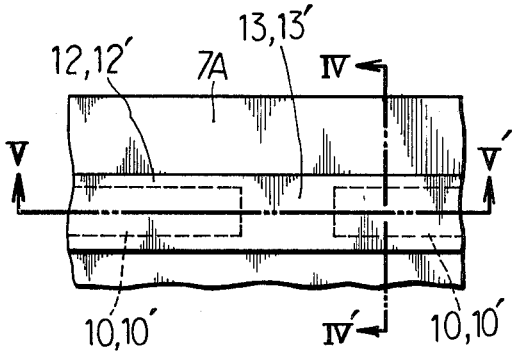
FIG. 3 is a fragmentary plan view on an enlarged scale of the connection between one connection line and the adjacent suppression resistance in the membrane keyboard assembly as shown in FIG. 2.
Figure 4:
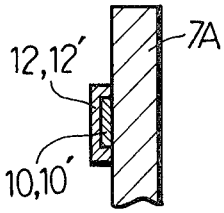
FIG. 4 is a cross-sectional view taken substantially along the line IV—IV of FIG. 3.
Figure 5:
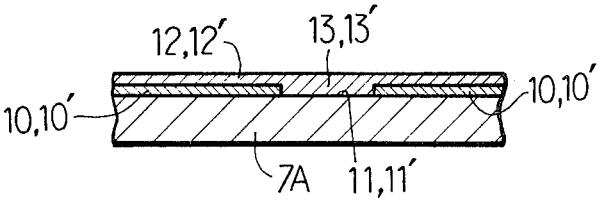
FIG. 5 is a cross-sectional view taken substantially along the line V—V of FIG. 3.

As more clearly shown in FIGS. 2 to 5 inclusive, the upper and lower membrane keyboards 2, 3 include a flexible base 7 in common. The flexible base 7 is formed of Mylar, for example. A slit 8 is formed in the center of the common base 7 extending transversely of the base so that the base 7 is easily folded upon itself and divided into two half portions 7', 7'' associated with the upper and lower membrane keyboards 2, 3, respectively. The flexible base portion 7'' associated with the lower membrane keyboard 3 is provided on the left side thereof as seen in FIG. 2 with an extension 7A and a connector 14 is connected to the free or outer end of the extension 7A. The flexible base portions 7', 7'' are provided with a plurality of contact areas 9, 9' formed by applying silver paint to corresponding selected areas thereon by the so-called screen printing and similarly, a plurality of connection lines 10, 10' are provided on the flexible base portions 7', 7'' (including the extension 7A) by applying silver paint thereto by the screen printing extending between the contact areas 9, 9' and the connector 14, respectively and between the adjacent contact areas 9, 9' themselves, respectively. The portions of the connection lines 10, 10' which are provided on the extension 7A of the flexible base portion 7'' are formed at spaced points along the length thereof with gaps 11, 11', respectively. The gaps 11, 11' are provided by masking the spaced points when the connection lines 10, 10' are screen-printed. The tops of the contact areas 9, 9' and of the connection lines 10, 10' including the gaps 11, 11' have carbon resistive layers 12, 12' applied thereto by the screen printing so that the resistive layers 12, 12' at the gaps 11, 11' will function as suppression resistances 13, 13' which are in series connected to the connection lines 10, 10'. Therefore, it will be noted that the suppression resistances 13, 13' are integrally formed with the screen-printed connection lines 10, 10' when the resistive layers 12, 12' are screen-printed. Since the suppression resistances 13, 13' are formed by the screen-printed resistive layers 12, 12' themselves, the production cost of the membrane keyboard assembly will be reduced accordingly. In addition, an additional operation to connect the discharge resistances 13, 13' to the connection lines 10, 10' can be eliminated and the membrane keyboard assembly can be formed having a small size. The resistance value of the suppression resistances 13, 13' can be optionally varied by selecting the length and width of the gaps 11, 11' as desired.

In the foregoing, although it has been described that the suppression resistances 13, 13' are provided on the extension 7A of the flexible base portion 7'', it will be understood that the location of the suppression resistances 13, 13' is not limited to the specified location.

In the foregoing description has been made of one preferred embodiment of the invention, but it will readily occur to those skilled in the art that the same is illustrative in nature, but does not limit the scope of the invention in any way. The scope of the invention is only limited to the appended claims.

What is claimed is:

1. A membrane keyboard assembly for use in a membrane keyboard switch device, comprising:

a flexible base;

plural contact areas formed on said flexible base;

plural connection lines formed on said flexible base and each connected to a respective one of said contact areas, said connection lines containing spaced gaps;

resistive layers applied to selected of said contact areas and said connection lines and the spaced gaps, whereby the portions of said resistive layers applied to said spaced gaps shunt said selected of said connection lines and said contact areas to form suppression resistances.

2. The membrane keyboard assembly as set forth in claim 1, in which said contact areas and said connection lines are formed of silver paint.

3. The membrane keyboard assembly as set forth in claim 1, in which said resistive layers are formed of carbon paint.

4. A membrane keyboard assembly for use in a membrane keyboard switch device comprising an upper membrane keyboard, a lower membrane keyboard having an undersurface, an apertured spacer interposed between said upper and lower membrane keyboards, a flexible surface sheet disposed on the top of said upper membrane keyboard and having switch indication means printed thereon and a bottom plate disposed on the undersurface of said lower membrane keyboard, said membrane keyboard assembly including a flexible base common to said upper and lower membrane keyboards and folded upon itself to provide first and second half portions which are associated with the upper and lower membrane keyboards, respectively, said base second half portion including an extension, a plurality of first contact areas formed on said base first half portion and a plurality of first connection lines formed on said base first half portion extending between said contact areas to connect the contact areas together, a plurality of second contact areas formed on said base second half portion and a plurality of second connection lines extending between said second contact areas to connect the second contact areas together, said second contact areas and second connection lines corresponding to said first contact areas and first connection lines with respect to number and location, respectively, and said first and second connection lines extending onto said extension of the base second half portion with the portions of said first and second connection lines on said extension of the base second half portion being formed at spaced points along the length thereof with gaps to break the lines, a connector connected to said first and second connection lines on said extension of the base second half portion, and resistive layers applied to said first and second contact areas and to said first and second connection lines and to said gaps, whereby the portions of said resistive layers present in the gaps in said portions of the first and second connection lines on said extension of the base second half portion shunt said portions of said first and second connection lines to form suppression resistances.

5. The membrane keyboard assembly as set forth in claim 4, in which said contact areas and connection lines are formed of silver paint.

6. The membrane keyboard assembly as set forth in claim 4, in which said resistive layers are formed of carbon paint.

7. The membrane keyboard assembly as set forth in claim 5, in which said contact areas and connection lines comprise:

said silver paint screen printed to said base.

8. The membrane keyboard assembly as set forth in claim 6, in which said resistive layers comprise:

said carbon paint screen printed to said base.

* * * * *